US008668760B2

(12) United States Patent
Achtermann et al.

(10) Patent No.: US 8,668,760 B2
(45) Date of Patent: Mar. 11, 2014

(54) METHOD FOR THE PRODUCTION OF A β-γ-TIAL BASE ALLOY

(75) Inventors: Dipl.-Ing Matthias Achtermann, Veitsbronn (DE); Willy Fürwitt, Fürth (DE); Volker Güther, Burgthann (DE); Dipl.-Mineraloge Hans-Peter Nicolai, Schwäbisch Gmünd (DE)

(73) Assignees: GfE Metalle und Materialien GmbH, Nürnberg (DE); TiTAL GmbH, Bestwig (DE)

( * ) Notice: Subject to any disclaimer, the term of this patent is extended or adjusted under 35 U.S.C. 154(b) by 233 days.

(21) Appl. No.: 13/130,643

(22) PCT Filed: Sep. 28, 2010

(86) PCT No.: PCT/EP2010/064306

§ 371 (c)(1), (2), (4) Date: May 23, 2011

(87) PCT Pub. No.: WO2011/047937

PCT Pub. Date: Apr. 28, 2011

(65) Prior Publication Data

US 2011/0219912 A1 Sep. 15, 2011

(30) Foreign Application Priority Data

Oct. 24, 2009 (DE) ..... 10 2009 050 603

(51) Int. Cl.
*C22B 4/02* (2006.01)

(52) U.S. Cl.
USPC ..... 75/10.65; 75/10.46; 75/10.48; 75/10.49; 75/10.54; 164/495

(58) Field of Classification Search
USPC ..... 75/10.46, 10.48, 10.49, 10.54, 10.65; 164/495
See application file for complete search history.

(56) References Cited

U.S. PATENT DOCUMENTS

| | | | |
|---|---|---|---|
| 6,051,084 | A | 4/2000 | Tetsui |
| 6,669,791 | B2 | 12/2003 | Tetsui et al. |
| 2006/0230876 | A1 | 10/2006 | Blum et al. |

FOREIGN PATENT DOCUMENTS

| | | | |
|---|---|---|---|
| DE | 1 179 006 | A | 10/1964 |
| DE | 195 81 384 | T1 | 12/1996 |

(Continued)

OTHER PUBLICATIONS

Clemens et al., "Design of Novel β-Solidifying TiAl Alloys with Adjustable β/B2-Phase Fraction and Excellent Hot-Workability", Advanced Engineering Materials 2008, 10, No. 8, p. 707-713.

(Continued)

*Primary Examiner* — Brian Walck
(74) *Attorney, Agent, or Firm* — McGlew and Tuttle, P.C.

(57) ABSTRACT

A method for the production of a γ-TiAl base alloy by vacuum arc remelting, which γ-TiAl base alloy solidifies via the β-phase (β-γ-TiAl base alloy), includes the following method steps of forming a basic melting electrode by melting, in at least one vacuum arc remelting step, of a conventional γ-TiAl primary alloy containing a lack of titanium and/or of at least one β-stabilizing element compared to the β-γ-TiAl base alloy to be produced; allocating an amount of titanium and/or β-stabilizing element to the basic melting electrode, which amount corresponds to the reduced amount of titanium and/or β-stabilizing element, in an even distribution across the length and periphery of the basic melting electrode; and adding the allocated amount of titanium and/or β-stabilizing element to the basic melting electrode so as to form the homogeneous β-γ-TiAl base alloy in a final vacuum arc remelting step.

10 Claims, 2 Drawing Sheets

(56) References Cited

FOREIGN PATENT DOCUMENTS

| | | | |
|---|---|---|---|
| DE | 196 31 583 | A1 | 2/1998 |
| DE | 101 56 336 | A1 | 6/2003 |
| JP | 02277736 | A | 11/1990 |

OTHER PUBLICATIONS

Guether et al., "Microstructure and Defects in γ-TiAl based Vacuum Arc Remelted Ingot Materials", 3rd Int. Symp. on Structural Intermetallics, Sep. 2001, Jackson Hole WY, USA.

Guether et al., "Status and Prospects of γ-TiAl Ingot Production"; Int. Symp. on Gamma Titanium Aluminides 2004, ed. H. Clemens, Y.-W. Kim and A.H. Rosenberger, San Diego, TMS 2004.

METHOD FOR THE PRODUCTION OF A β-γ-TIAL BASE ALLOY

CROSS REFERENCE TO RELATED APPLICATIONS

This application is a United States National Phase application of International Application PCT/EP2010/064306 and claims the benefit of priority under 35 U.S.C. §119 of German patent application DE 10 2009 050 603.9 filed Oct. 24, 2009, the entire contents of which are incorporated herein by reference.

FIELD OF THE INVENTION

The invention relates to a method for the production of β-γ-TiAl base alloys by means of vacuum arc remelting (VAR) which solidify, either completely or at least partially, primarily via the β-phase. Final alloys of this type are hereinafter referred to as β-γ-TiAl base alloys.

BACKGROUND OF THE INVENTION

The technical field of the present invention is the production of β-γ-TiAl alloys in a melting metallurgical process by means of vacuum arc remelting (VAR). In prior-art methods, the raw materials sponge titanium, aluminum as well as alloy elements and master alloys are compacted to form compact bodies which contain the desired alloy components in the correct stoichiometric ratio. If necessary, evaporation losses caused by the subsequent melting process are pre-compensated. The compacts are either molten directly to form so-called ingots by means of plasma melting (PAM) or they are assembled to form consumable electrodes which are then molten to form ingots (VAR). In both cases, materials are produced whose chemical and structural homogeneity is not suitable for technical use and which therefore need to be remolten at least once (see V. Guether: "Microstructure and Defects in γ-TiAl based Vacuum Arc Remelted Ingot Materials", 3rd Int. Symp. On Structural Intermetallics, September 2001, Jackson Hole Wyo., USA).

DE 101 56 336 A1 discloses a method for the production of alloy ingots which comprises the following method steps:

(I) production of electrodes by mixing and compacting the selected materials in the usual manner;

(ii) remelting the electrodes obtained in (I) at least once in a conventional melting metallurgical process;

(iii) induction melting of the electrodes obtained in (I) or (ii) in a high-frequency coil;

(iv) homogenizing the melt obtained in (iii) in a cold wall induction crucible; and (v) removing the melt, solidified by cooling, from the cold wall induction crucible used in (iv) in the form of blocks having a freely selectable diameter.

DE 195 81 384 T1 describes intermetallic TiAl compounds and methods for the production thereof, with the alloy being produced by heat treatment at a temperature in the range of 1300° C. to 1400° C. of an alloy having a Ti-concentration of 42 to 48 atomic %, an Al-concentration of 44 to 47 atomic %, an Nb-concentration of 6 to 10 atomic % and a Cr-concentration of 1 to 3 atomic %.

DE 196 31 583 A1 discloses a method for the production of a TiAl—Nb product of an alloy in which an alloy electrode is produced from the alloy components in a first step. The alloy electrode is formed by compacting and/or sintering the alloy components to form the electrode. The electrode is molten by an induction coil.

JP 02277736 A discloses a heat-resistant TiAl base alloy in which specific amounts of V and Cr are added to an intermetallic TiAl-compound to improve the heat-resistance and ductility thereof.

Finally, DE 1 179 006 A discloses ternary or higher titanium aluminum alloys containing elements which stabilize the α- and β-phase of the titanium.

The process of vacuum arc remelting using a consumable electrode is the usual method for remelting as the plasma melting furnaces are usually not designed for supplying starting materials in the form of compact ingots. In the example of conventional two-phase γ-TiAl base alloys comprising lamellar colonies of the α2-TiAl3 phase and the γ-TiAl phase, remelting in the vacuum arc remelting furnace (VAR furnace) occurs without any difficulties so that the desired result is obtained (see V. Guether: Status and Prospects of γ-TiAl Ingot Production"; Int. Symp. On Gamma Titanium Aluminides 2004, ed. H. Clemens, Y.-W. Kim and A. H. Rosenberger, San Diego, TMS 2004).

A new generation of γ-TiAl high-performance materials such as the so-called TNM®-alloys of the applicant possesses a structure which is different from conventional TiAl alloys. In particular by reducing the aluminum content to usually 40 at. % to 45.5 at. % and by adding β-stabilizing elements such as Cr, Cu, Hf, Mn, Mo, Nb, V, Ta and Zr, a primary solidification path is obtained in the β-Ti-phase. The result is a very fine structure which contains lamellar $\alpha_2/\gamma$ colonies as well as globular β grains and globular γ grains, sometimes even globular $\alpha_2$ grains. Materials having such structures possess decisive advantages in terms of their thermo-mechanical properties and their processibility by means of forming technologies (see H Clemens: "Design of Novel β-Solidifying TiAl Alloys with Adjustable β/B2-Phase Fraction and Excellent Hot-Workability", Advanced Engineering Materials 2008, 10, No. 8, p. 707-713). As already mentioned at the outset, such alloys are hereinafter referred to as β-γ-TiAl base alloys.

The drawback is that when electrodes of this material are remolten again in the VAR furnace, cracks are formed which often cause components of the consumable alloy electrode to chip off the electrode in the initial melting zone. These chippings fall into the molten pool where they are not completely remolten again. This causes structural defects in the ingot, with the result that the ingot material is no longer suitable for use. Under these conditions, remelting in the VAR furnace is no longer possible in a technically reproducible manner.

The undesirable chipping behavior is supposed to be caused by massive phase shifts in the temperature range between the eutectoid temperature and the phase limit temperature to the β single phase region. In particular in the event of phase shifts, the different linear expansion coefficients of the various phase components cause sudden changes of the integral linear heat expansion coefficient of the alloy, which results in internal stresses that exceed the stability of the material in the given temperature range.

Corresponding dilatometer measurements in a TNM®-B1-alloy (Ti-43.5 AL-4.0 Nb-1.0 Mo-0.1 B at. %) show that the linear expansion coefficient of a corresponding alloy sample is more than multiplied in the temperature range between 1000° C. and 1200° C., in other words it increases from $9\times10^{-6}$ to $40\times10^{-6}K^{-1}$. This behavior is shown in the attached FIG. 4 where the curve A represents the linear expansion coefficient of this alloy. The line R represents the heating rate of the sample.

During VAR melting, a temperature field from melting temperature (approx. 1570° C.) at the lower side of the electrode to almost ambient temperature at the electrode suspension extends through the material relative to the length of the consumable electrode. Near the melt front, the critical temperature range of between 1000 and 1200° C. is reached. In this zone, the relatively poor ductility of the intermetallic material causes cracks to form in this zone as a result of the stresses occurring there, which in turn cause non-molten pieces to chip off the electrode as described above.

SUMMARY OF THE INVENTION

Based on the described prior art problems, it is the object of the invention to provide a method for the production of a γ-TiAl base alloy which solidifies via the β-phase—hereinafter referred to as β-γ-TiAl base alloy—so as to ensure a reliable production of such a final alloy while preventing the problem of crack formation.

This object is achieved by the invention as follows:

- forming a basic melting electrode by melting, in at least one vacuum arc remelting step, of a conventional γ-TiAl primary alloy containing a lack of titanium and/or of at least one β-stabilizing element compared to the β-γ-TiAl base alloy to be produced;
- allocating an amount of titanium and/or β-stabilizing element to the basic melting electrode, which amount corresponds to the reduced amount of titanium and/or β-stabilizing element, in an even distribution across the length and periphery of the basic melting electrode;
- adding the allocated amount of titanium and/or β-stabilizing element to the basic melting electrode so as to form the homogeneous β-γ-TiAl base alloy in a final vacuum arc remelting step.

The consecutive remelting steps during vacuum arc remelting are thus subdivided into melting a primary alloy in the first remelting steps, with a basic melting electrode being formed of a conventional γ-TiAl primary alloy, and melting the final alloy in the form of the desired β-γ-TiAl base alloy in the final remelting step. The primary alloy contains a lack of titanium and/or a lack of β-stabilizing elements such as Nb, Mo, Cr, Mn, V and Ta. When producing the compacted basic melting electrode, a defined amount of titanium and/or β-stabilizing elements is removed from the alloy, with the result that an aluminum content of the primary alloy is preferably between 45 at % (particularly preferably 45.5 at. %) and 50 at. %. The contents of aluminum and β-stabilizing elements are selected in such a way that solidification of the primary alloy occurs at least partially via peritectic transformation. Thus a structure is achieved which is similar to conventional TiAl alloys and is processable in the VAR furnace without any difficulties.

In the final remelting step, the final alloy is reproduced by adding the materials originally removed from the compacted electrode. Preferably, these materials are rigidly welded to the outer peripheral surface of the melting electrode in the form of a coat so as to form a composite electrode in order to prevent the solidified materials from falling into the melt pool. It is conceivable as well to achieve this by forming a lining of the lacking alloy component on the inside of the remelting die of the VAR furnace.

Surprisingly it turns out that by appropriately selecting and evenly distributing the lacking alloy components on the outer peripheral surface of the electrode, there will be no negative consequences for the local chemical homogeneity of the emerging ingot of the final alloy to be produced in the form of the β-γ-TiAl base alloy.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
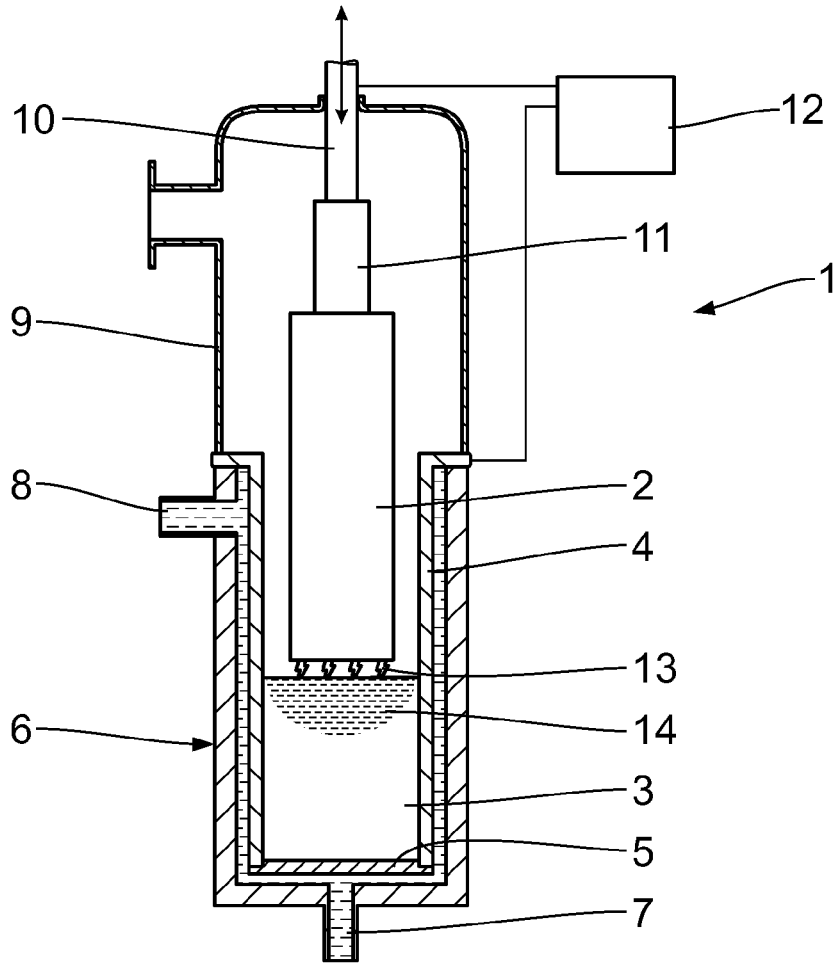
FIG. 1 is a schematic view of a vacuum arc remelting furnace.

FIG. 1 serves to explain general aspects of a vacuum arc remelting furnace 1 and of the method of remelting a corresponding electrode 2 to form an ingot 3. The VAR furnace 1 comprises a copper crucible 4 having a bottom plate 5. This copper crucible 4 is surrounded by a water cooling coat 6 comprising a water inlet 7 and a water discharge 8. Furthermore, the copper crucible 4 is sealed from above by means of a vacuum bell jar 9 the upper side of which is passed through by a vertically displaceable lifting rod 10. This lifting rod 10 is provided with the retainer 11 from which the actual electrode 2 is suspended.

A direct voltage is applied between copper crucible 4 and lifting rod 10 via a direct current supply 12 which causes a high-current arc to be ignited and maintained between the electrode 2, which is electrically connected to the lifting rod 10, and the copper crucible 4. This causes the electrode 2 to melt, with the molten alloy material being collected in the copper crucible 4 where it solidifies. The electrode 2 is successively remolten to form the ingot 3 in a continuous process in which the arc runs over the electrode arc gap 13 from the consumable electrode 2 to the molten reservoir 14 on the upper side of the ingot 3; in this process, the alloy components are homogenized.

This process may be repeated several times using melting crucibles of increasing diameters, with the ingot of one remelting step then serving as electrode in the following remelting step. Consequently, the degree of homogenization of the ingots to be produced is improved in each remelting step.

The following is a description of several examples for the production of a β-γ-TiAl base alloy.

Example 1

The final composition of the β-γ-TiAl base alloy is Ti-43.5Al-4.0Nb-1.0Mo-0.1B (at. %) or Ti—Al28.6-Nb9.1-Mo2.3-B0.03 (m. %). The composition of the primary alloy for the basic melting electrode is determined by reducing the titanium content to Ti-45.93Al-4.22Nb-1.06Mo-0.11B (at. %). In a first step, an ingot 3 of the primary alloy having a diameter of 200 mm and a length of 1.4 m is produced in a conventional process as described above from a compacted electrode 2 by double VAR melting without causing cracks to form. Materials used in the production of the compacted electrode 2 are sponge titanium, pure aluminum and master alloys.

Figure 2:
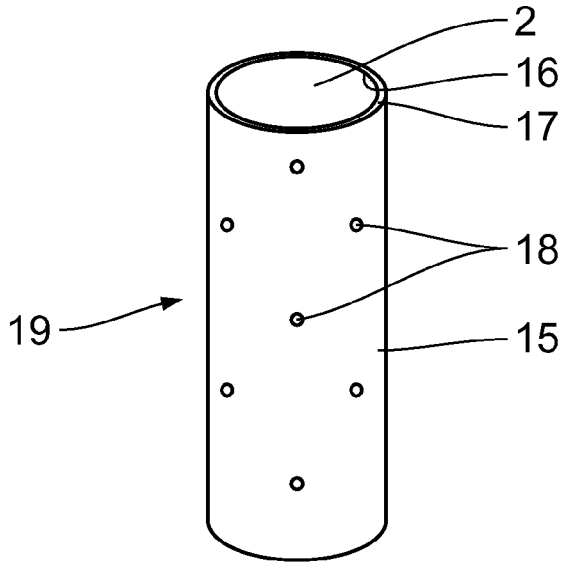
FIG. 2 is a perspective view of composite electrode in a first embodiment.

In order to increase the reduced titanium content in the basic melting electrode to the desired amount of the β-γ-TiAl base alloy in the final alloy, the entire outer peripheral surface of the ingot 3 from the primary alloy is wrapped into a pure titanium sheet 15 having a thickness of 3 mm (mass 12 kg) which is partially welded to the outer peripheral surface 16 of the ingot 3 as shown in FIG. 2. In this process, the upper edge 17 of the titanium sheet 15 is welded to ingot 3 across the entire periphery thereof. Furthermore, welding spots 18 are distributed over the outer peripheral surface 16. The consumable electrode assembled in this manner serves as a composite electrode 19 in a final melting step in the VAR furnace 1 where it is remolten to form an ingot 3 having a diameter of 280 mm and the composition of the final alloy.

Example 2

The final composition, the used materials and the composition of the primary alloy correspond to those of example 1. By simple VAR melting of compacted electrodes 2, the primary alloy is transformed into an ingot 3 having a diameter of 140 mm and a length of 1.8 m.

The mass of the ingot amounts to 115 kg. Prior to the final melting process of the basic melting electrode 2, the die of the VAR furnace 1, which is formed by the copper crucible 4, is lined on its inner peripheral surface with a sheet of pure titanium having the following dimensions: periphery 628 mm×height 880 mm×thickness 3 mm (mass 7.6). In other words, the final composition is obtained by combining the composition of primary alloy ingot forming the basic melting electrode 2 with that of the titanium sheet. The basic melting electrode 2 is remolten in the copper crucible 4 lined with the titanium sheet to form an intermediate electrode in such a way that the outer skin of the titanium sheet is not completely molten so that a stable shell remains. In the subsequent final VAR melting step of the intermediate electrode, it is possible for cracks to form; the mechanical stabilization by the ductile outer skin however prevents electrode material from falling into the melt reservoir 14.

Example 3

The final composition, the materials used as well as the composition of the primary alloy and the production of the composite electrode 19 correspond to example 1. In contrast to example 1, the final remelting step of the composite electrode 19 takes place in a so-called 'VAR skull melter', in other words a vacuum arc melting device comprising a water-cooled, tiltable melting crucible of copper. The molten material of the final alloy in the 'skull' is cast into permanent dies of stainless steel which are arranged on a rotating casting wheel. The cast bodies thus produced by centrifugal casting are used as primary material for the production of components from the final alloy.

Example 4

Figure 3:
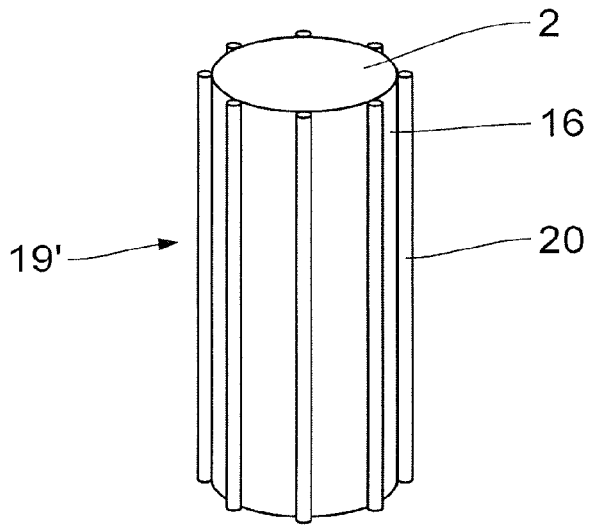
FIG. 3 is a perspective view of a composite electrode in a second embodiment.
Figure 4:
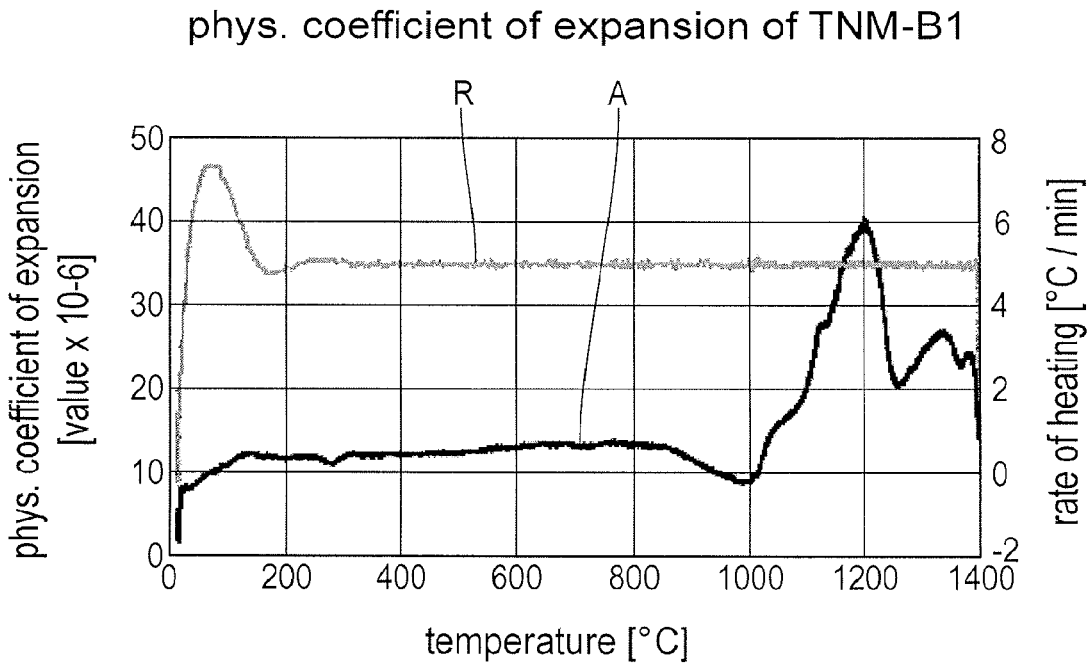
FIG. 4 is a diagram of the linear expansion coefficient as a function of the temperature of a TNM®-B1-alloy.

A β-γ-TiAl alloy according to U.S. Pat. No. 6,669,791, the entire contents of which are incorporated herein by reference, has a composition (final alloy) of Ti-43.0Al-6.0V (at. %) or Ti—Al29.7-V7.8 (m %), respectively. The composition of the primary alloy is determined as Ti-45.75Al (at. %) or Ti—Al32.2 (m. %), respectively, by the complete reduction of the highly β-stabilizing element vanadium. The materials used are sponge titanium, aluminum and vanadium. In a first step, a basic melting electrode 2 having a diameter of 200 mm and a length of 1 m is produced as an ingot of the binary TiAl primary alloy by double VAR melting (mass 126 kg). As shown in FIG. 3, eight vanadium rods 20, which have a diameter of 16.7 mm and a length of 1 m (total mass 10.7 kg) and which are in each case offset by 45° so as to be evenly distributed across the periphery of the basic melting electrode 2, are welded to the periphery of the electrode 2 along the entire outer peripheral surface 16 thereof in a direction parallel to the longitudinal axis. In the final third melting process, the composite electrode 19' thus formed of the binary primary alloy and the vanadium rods 20 welded thereto is remolten in the VAR furnace 1 to form an ingot having the final alloy and a diameter of 300 mm.

Example 5

The final composition of the γ-TiAl alloy corresponds to that of example 1 (Ti-43.5Al-4.0Nb-1.0Mo-0.1B at. %). The composition of the primary alloy is determined as Ti-49.63Al-4.57Nb-0.11B (at. %) by a complete reduction of the molybdenum content and a partial reduction of the titanium content. By double VAR melting, the primary alloy is transformed into a basic melting electrode 2 having a diameter of 200 mm and a length of 1 m. The mass of the ingot amounts to 126 kg. In analogy to example 4, eight rods consisting of the commercial alloy TiMo15 are welded to the outer peripheral surface 16 of the electrode 2 in a direction parallel to the longitudinal axis. The diameter of the rods amounts to 26 mm, the length of the rods corresponds to the length of the ingot. The total mass of the TiMo15 rods amounts to 19.6 kg. In the final third melting process, the composite electrode thus formed of an ingot of the primary alloy and eight TiMo15 rods is remolten in the VAR furnace 1 to form an ingot of the final alloy having a diameter of 300 mm.

While specific embodiments of the invention have been described in detail to illustrate the application of the principles of the invention, it will be understood that the invention may be embodied otherwise without departing from such principles.

The invention claimed is:

1. A method for the production of a β-γ-TiAl base alloy by vacuum arc remelting wherein said β-γ-TiAl base alloy solidifies via the β-phase, the method comprising the following method steps:

forming a basic melting electrode by melting, in at least one vacuum arc remelting step, of a conventional γ-TiAl primary alloy containing a lack of at least one of titanium and at least one β-stabilizing element compared to the β-γ-TiAl base alloy to be produced;

allocating an amount of at least one of titanium and said β-stabilizing element to the basic melting electrode, wherein said amount corresponds to the reduced amount of at least one of titanium and the β-stabilizing element, in an even distribution across a length and periphery of the basic melting electrode;

adding the allocated amount of at least one of titanium and said β-stabilizing element to the basic melting electrode so as to form the homogeneous β-γ-TiAl base alloy in a final vacuum arc remelting step.

2. A method for the production of a β-γ-TiAl base alloy according to claim 1, wherein the basic melting electrode of the conventional γ-TiAl base alloy has an aluminum content of 45 at. % to 50 at. %.

3. A method for the production of a β-γ-TiAl base alloy according to claim 1, wherein the basic melting electrode has a lack of at least one of titanium and at least one element of B, Cr, Cu, Hf, Mn, Mo, Nb, Si, Ta, V and Zr which have a β-stabilizing effect in TiAl alloys.

4. A method for the production of a β-γ-TiAl base alloy according to claim 1, wherein the basic melting electrode is produced by one of single and multiple remelting of a compacted electrode comprising the alloy components of the basic melting electrode in a homogeneous distribution.

5. A method for the production of a β-γ-TiAl base alloy according to claim 1, wherein in order to allocate the amount of at least one of titanium and the β-stabilizing element corresponding to the lacking amount of at least one of titanium and the β-stabilizing element to the basic melting electrode, a composite electrode is produced which consists of the basic melting electrode and a layer of a corresponding thickness of at least one of titanium and the β-stabilizing element which is constant across the periphery and length thereof.

6. A method for the production of a β-γ-TiAl base alloy according to claim 5, wherein the layer consists of a coat of titanium sheet which extends along the length of the basic melting electrode.

7. A method for the production of a β-γ-TiAl base alloy according to claim 6, wherein the coat of titanium sheet is secured to the basic melting electrode by means of at least one of welding spots which are evenly distributed across the outer peripheral surface thereof and a weld seam which runs along an upper edge of said basic melting electrode across the entire periphery thereof.

8. A method for the production of a β-γ-TiAl base alloy according to claim 6, wherein the coat of titanium sheet is formed by a coat lining on the inside of a remelting die of the vacuum arc melting furnace, with the coat of titanium sheet being fused to the basic melting electrode in an intermediate remelting step so as to form an intermediate electrode which is then remolten to form the homogeneous β-γ-TiAl base alloy in a final vacuum arc melting step.

9. A method for the production of a β-γ-TiAl base alloy according to claim 1, wherein in order to allocate the amount of at least one of titanium and the β-stabilizing element corresponding to the lacking amount of at least one of titanium and the β-stabilizing element to the basic melting electrode, a composite electrode is formed which consists of the basic melting electrode and several rods of corresponding thickness consisting of at least one of titanium and the β-stabilizing element which are arranged parallel to a longitudinal axis of the basic melting electrode and are distributed evenly across the periphery of the basic melting electrode.

10. A method for the production of a β-γ-TiAl base alloy according to claim 1, wherein the final vacuum arc melting step for forming the homogeneous β-γ-TiAl base alloy is performed in a vacuum arc skull melting device after which the molten material of the β-γ-TiAl base alloy is cast to form cast bodies of the β-γ-TiAl base alloy in one of a lost-wax and a die casting process.

* * * * *